United States Patent [19]

Takeuchi

[11] Patent Number: 5,074,141

[45] Date of Patent: Dec. 24, 1991

[54] BOLSTER APPARATUS FOR PRESS-FORMING WORKPIECES

[75] Inventor: Hajime Takeuchi, Chita, Japan

[73] Assignee: Aichi Steel Works, Ltd., Tokai, Japan

[21] Appl. No.: 428,060

[22] Filed: Oct. 27, 1989

[30] Foreign Application Priority Data

| | | | |
|---|---|---|---|
| Oct. 29, 1988 | [JP] | Japan | 63-141645 |
| Oct. 29, 1988 | [JP] | Japan | 63-274135 |
| Oct. 31, 1988 | [JP] | Japan | 63-142664 |

[51] Int. Cl.[5] ..... B21D 43/10

[52] U.S. Cl. ..... 72/405; 72/361; 198/621

[58] Field of Search ..... 72/405, 421, 361; 198/621; 414/750

[56] References Cited

U.S. PATENT DOCUMENTS

| | | | |
|---|---|---|---|
| 3,057,312 | 10/1962 | Hatch . | |
| 3,262,541 | 7/1966 | DeGain | 198/621 |
| 3,422,657 | 1/1969 | Grombka | 72/405 |
| 3,707,908 | 2/1973 | Merk . | |
| 3,746,184 | 7/1973 | Wallis | 72/405 |
| 4,032,018 | 6/1977 | Wallis | 414/750 |

FOREIGN PATENT DOCUMENTS

| | | | |
|---|---|---|---|
| 2814118 | 10/1979 | Fed. Rep. of Germany | 72/405 |
| 3722250 | 6/1988 | Fed. Rep. of Germany . | |
| 902216 | 8/1945 | France . | |
| 1390539 | 1/1965 | France . | |
| 2582241 | 11/1986 | France . | |
| 1250117 | 10/1971 | United Kingdom | 72/405 |
| 1370686 | 10/1974 | United Kingdom . | |

OTHER PUBLICATIONS

Metalworking Production, vol. 104, No. 22, Jun. 1, 1960, pp. 986–987.

*Primary Examiner*—Daniel C. Crane
*Attorney, Agent, or Firm*—Berman & Aisenberg

[57] ABSTRACT

This invention relates to a process for press-forming workpieces and a bolster apparatus for the same. The process employs a first bolster apparatus comprising a die holding portion and a transfer, and a second bolster apparatus comprising a die holding portion and a transfer. The process comprises the steps performed sequentially: an exchanging step of removing the first bolster apparatus from a bolster mounting portion of a pressing apparatus and mounting the second bolster apparatus to a bolster mounting portion of the pressing apparatus, thereby exchanging the first bolster apparatus with the second bolster apparatus; and a press-forming step of press-forming second workpieces with the second dies held in the second bolster apparatus by operating the pressing apparatus. The process and the bolster apparatus improve the productivity, and are advantageous when producing various types of products by the small lot, because the transfer can be exchanged simultaneously with the exchange of the bolster apparatuses. In addition, the bolster apparatus has done away with the base for the transfer, because the transfer is incorporated in the bolster apparatus.

2 Claims, 15 Drawing Sheets

A
A100
A100
1
2
3
4
5
6
10
10a
10a
14
17
17a
20
21
22
23
24
30
31
32
33
34
81
82
170
171
172
173
174
175
176
177
X1
X2
Y1
Y2
522

BOLSTER APPARATUS FOR PRESS-FORMING WORKPIECES

BACKGROUND OF THE INVENTION

1. Field of the Invention

This invention relates to a process for press-forming workpieces and a bolster apparatus applicable to the same. In particular, this invention relates to a process for press-forming workpieces and a bolster apparatus applicable to the same, in which the workpieces are transferred and press-formed one after another. This invention is applicable to a bolster apparatus holding forging dies.

2. Description of the Prior Art

When performing a forging press process, a bolster is mounted to a bolster mounting portion of a forging press apparatus, a rough forging die, a finish forging die and a deflashing die are then disposed in series in die holding bores of the bolster, and a transfer is further provided to the forging press apparatus independently of the bolster. In this conventional arrangement, the forging press apparatus and the transfer are operated. Rough forged products are produced by the rough forging die from a blank material, the rough forged products produced are transferred to the finish forging die by the transfer, finish forged products are then produced by the finish forging die from the rough forged products, the finish forged products produced are transferred to the deflashing die by the transfer, and the finish forged products are finally deflashed by the deflashing die.

In the above-mentioned forging press process, a base exclusively for the transfer should be provided on the floor because the transfer is provided to the forging press apparatus independently of the bolster. In addition, when changing production set-ups from one product to another product, not only the rough forging die, the finish forging die and the deflashing die but also the bolster for holding these dies should be exchanged. Further, when a production set-up has been changed and the workpiece transfer pitch has been varied, the transfer should be exchanged in addition to the above-mentioned exchanges of the forging dies and bolster. It is therefore disadvantageous in view of productivity because a process for exchanging the transfer is required as well as a process for exchanging the forging dies and the bolster.

In order to overcome the above-mentioned drawbacks, a transfer adapted to the multi-function or the multi-purpose application should be employed to make the workpieces transferable with an identical transfer even when the production set-ups have been changed. Consequently, the mechanism and function of the transfer is complicated, and the cost thereof is high.

For example, a schematic plan view of a conventional transfer is illustrated in FIG. 19. As shown in FIG. 19, the conventional transfer comprises frames 901 comprising a workpiece transfer path 900 extending in the X-direction, and a square movement mechanism 902 for intermittently transferring workpieces on the workpiece transfer path 900 in the X-direction.

The square movement mechanism 902 comprises a driving mechanism 903 disposed at one end of the X-direction, i.e., at the beginning end of the workpiece transfer, a driven mechanism 904 disposed at the other end of the X-direction, i.e., at the terminating end of the workpiece transfer, and a beam-shaped synchronizing mechanism 905 for connecting and synchronizing the driving and driven mechanisms 903 and 904. The driving mechanism 903 is provided with an X-direction driver. The beam-shaped synchronizing mechanism 905 is driven to perform a square movement along the X-direction in the upward and downward directions. The synchronizing mechanism 905 is provided with transfer claws 906 for holding workpieces. When the synchronizing mechanism 905 is driven to perform the square movement mechanism in the upward and downward directions, the workpieces held by the transfer claws 906 are intermittently transferred on the workpiece transfer path 900 one after another in the X-direction by one (1) pitch. The workpieces thus transferred are processed at processing steps disposed at every one (1) pitch.

The above-mentioned conventional transfer is provided with the square movement mechanism 902. The square movement mechanism 902 comprises the driving mechanism 903 disposed at one end of the X-direction, i.e., at the beginning end of the workpiece transfer, the driven mechanism 904 disposed at the other end of the X-direction, i.e, at the terminating end of the workpiece transfer, and the beam-shaped synchronizing mechanism 905 for synchronizing the driving and driven mechanisms 903 and 904. In the square movement mechanism 902, the synchronizing mechanism 905 is bridged in the X-direction, in which the workpieces are transferred one after another. When the number of workpiece processing steps increases, the length of the workpiece transfer path 900 increases. Accordingly, the beam-shaped synchronizing mechanism 905 should be made longer, and it is required to highly strengthen and rigidify the beam-shaped synchronizing mechanism 905 in order to prevent the beam-shaped synchronizing mechanism 905 from bending. As a result, the weight and inertia force of the beam-shaped synchronizing mechanism 905 increase. Therefore, in the above-mentioned conventional transfer, the inertia force thereof, exerted by the square movement of the beam-shaped synchronizing mechanism 905, tends to increase when the number of workpiece processing steps increases.

Further, in the above-mentioned forging press apparatus, each of the rough forging die, the finish forging die and the deflashing die is made integral. Consequently, it is not always easy to take out the products from the cavities of the dies, depending on the cavity configurations, volumes and the like of the dies.

SUMMARY OF THE INVENTION

This invention has been developed in view of the above-mentioned drawbacks. It is therefore an object of this invention to provide a workpiece press-forging process and a bolster apparatus applicable to the same for improving productivity, in which a transfer can be exchanged simultaneously with the exchange of a bolster apparatus.

It is another object of this invention to provide a bolster apparatus effectively avoiding the increasing inertia force of a synchronizing mechanism thereof even when the number of workpiece processing steps increases and the length of a workpiece transfer path increases accordingly.

It is still another object of this invention to provide a bolster apparatus in which workpieces are taken out readily from the cavities of the press-forming dies thereof.

A process for press-forming workpieces according to this invention employs a first bolster apparatus comprising a die holding portion for holding first dies for press-forming first workpieces and holding a transfer for transferring said first workpieces and a second bolster apparatus comprising a die holding portion for holding second dies for press-forming second workpieces and holding a transfer for transferring said second workpieces. The process for press-forming workpieces according to this invention comprises the steps performed sequentially: an exchanging step of removing the first bolster apparatus from a bolster mounting portion of a pressing apparatus and mounting the second bolster apparatus to a bolster mounting portion of the pressing apparatus, thereby exchanging the first bolster apparatus with the second bolster apparatus; and a press-forming step of press-forming the second workpieces with the second dies of the second bolster apparatus by operating the pressing apparatus.

A bolster apparatus according to this invention is employed when performing the above-mentioned process for press-forming workpieces. The bolster apparatus according to this invention comprises: a bolster main body comprising a mounting portion to be mounted to a mounting portion of a pressing apparatus and a die holding portion capable of holding at least three (3) dies disposed in series; and a first die, a second die and a third die held in the bolster main body, wherein the bolster main body further comprises: a set of transfer claws disposed in a manner capable of performing a square movement in the two-dimensional direction and comprising a pair of first transfer claws for transferring a workpiece from the first die to the second die; a pair of second transfer claws for transfering a workpiece from the second die to the third die; and a pair of third transfer claws for transfering a workpiece from the third die to the other location; and a square movement mechanism for operating the square movement of the first transfer claws, the second transfer claws and the third transfer claws, constituting the set of transfer claws, in the two-dimensional direction.

The process for press-forming workpieces according to this invention will be hereinafter described. The dies exclusively for the first workpieces and the transfer exclusively therefor are assembled to the first bolster apparatus exclusively for the first workpieces. Similarly, the dies exclusively for the second workpieces and the transfer exclusively therefor are assembled to the second bolster apparatus exclusively for the second workpieces. When the type of workpieces to be press-formed is changed from the first workpieces to the second workpieces, the first bolster apparatus exclusively for the first workpieces which has been used so far is removed from the pressing apparatus, and thereby the dies exclusively for the first workpieces and the transfer therefor which have been used so far are removed from the pressing apparatus. Then, the second bolster apparatus exclusively for the second workpieces to be press-formed from now on is assembled to the pressing apparatus, and thereby the dies exclusively for the second workpieces to be press-formed from now on are assembled to the pressing apparatus.

The bolster apparatus according to this invention will be hereinafter described. The bolster main body has the mounting portions to be mounted to the bolster mounting portion of the pressing apparatus. The structure of the bolster mounting portion may be determined as the occasion may demand. The following are representatives of the pressing apparatus: a forging press apparatus, a sheet metal pressing apparatus and the like. The die holding portion of the bolster main body has a structure for holding dies for press-forming workpieces. For instance, the structure may comprise die holding bores. The first die, the second die and the third die are at least held by the die holding portion of the bolster main body. For the first, second and third dies, forging dies, sheet metal pressing dies, punching dies, drawing dies and the like may be employed depending on the type of the press-formings. When employing the forging dies, as described in the section of "DESCRIPTION OF THE PREFERRED EMBODIMENT OF THE INVENTION", the following dies are representatives of the first, second and third dies respectively: a rough forging die, a finish forging die and a deflashing die.

The bolster main body further comprises a set of transfer claws disposed in a manner capable of performing the square movement in the two-dimensional direction, and the square movement mechanism for operating the square movement of the set of the transfer claws in the two-dimensional direction.

Here, the square movement means a movement comprising a movement for advancing and retracting the set of transfer claws in the two-dimensional direction and a movement for opening and closing the set of transfer claws in the two-dimensional direction. The set of transfer claws comprises the pair of the first transfer claws, the pair of the second transfer claws and the pair of the third transfer claws at least. Configurations of the set of the transfer claws may be determined depending on the occasion, for instance, they may be a finger shape, a grip shape and the like.

According to the process for press-forming workpieces of this invention, when exchanging of the pressing apparatus has been completed from the first bolster apparatus to the second bolster apparatus, the dies for press-forming workpieces and the transfers therefor are exchanged automatically.

The operation of the bolster apparatus according to this invention will be hereinafter described along with its usage. The mounting portion of the bolster main body is first mounted to the bolster mounting portion of the pressing apparatus. When the pressing apparatus with the bolster apparatus mounted is operated, a workpiece is pressed by the first die. The first transfer claws are operated by the operation of the square movement mechanism held in the bolster main body, thereby transferring the workpiece pressed by the first die to the second die. Then, the workpiece pressed by the first die is pressed by the second die. Further, the second transfer claws are operated by the operation of the square movement mechanism, thereby transferring the workpiece pressed by the second die to the third die. Similarly, the third transfer claws are operated by the operation of the square movement mechanism, thereby transferring the workpiece pressed by the third die to the other location.

It is thus apparent that the process for press-forming workpieces according to this invention is advantageous not only for improving productivity but also for producing various types of products by the small lot, because the transfer can be exchanged simultaneously with the exchange of the bolster apparatuses.

The bolster apparatus according to this invention has enabled the above-mentioned process for press-forming workpieces of this invention. In addition, the bolster apparatus according this invention has done away with the base for the transfer, because the square movement mechanism constituting the transfer is incorporated in the bolster main body.

Further, the arrangement of the bolster apparatus according to this invention is advantageous for reducing the inertia force thereof, because the weight of the transfer thereof can be kept substantially the same even when the number of workpiece processing steps increases.

Furthermore, in the bolster apparatus according to this invention, at last one of the dies can be made separable and movable in a manner interlocking with the movement of the transfer. Thus, the bolster apparatus according to this invention enables to easily take-out the workpieces from the dies.

BRIEF DESCRIPTION OF THE DRAWING

A more complete appreciation of the invention and many of the attendant advantages thereof will be readily obtained as the same becomes better understood by reference to the following detailed description when considered in connection with the accompanying drawings, wherein:

FIGS. 5 and 6 illustrate first transfer claws of the preferred embodiment of the bolster apparatus according to this invention, wherein;

FIG. 5 is an enlarged plan view thereof; and

FIG. 6 is an enlarged cross-sectional view thereof;

FIGS. 7 through 11 illustrate a driving bolster member and a driving mechanism of a square movement mechanism of the preferred embodiment of the bolster apparatus according to this invention, wherein;

FIG. 7 is a view taken in the direction of the arrows A—A of FIG. 10;

FIG. 8 is a view taken in the direction of the arrows B—B of FIG. 10;

FIG. 9 is a plan view of the driving mechanism with both of the top and bottom covers thereof removed and also a view taken in the direction of the arrows G—G of FIG. 10;

FIG. 10 is a side view of the driving mechanism and also a view taken in the direction of arrows D—D of FIG. 9; and FIG. 11 is a view taken in the direction of the arrow E of FIG. 8;

FIGS. 12 through 14 illustrate a driven bolster member and a driven mechanism of a square movement mechanism of the preferred embodiment of the bolster apparatus according to this invention, wherein;

FIG. 12 is a plan view of the driven mechanism with both of the top and bottom covers thereof removed;

FIG. 13 is a plan view thereof and corresponds to FIG. 8;.and

FIG. 14 is a plan view thereof and corresponds to FIG. 7;

DESCRIPTION OF THE PREFERRED EMBODIMENT OF THE INVENTION

Having generally described this invention, a further understanding can be obtained by reference to certain specific preferred embodiment which is provided herein for purposes of illustration only and is not intended to be limiting unless otherwise specified.

A representative preferred embodiment of a bolster apparatus according to this invention will be hereinafter described in detail with reference to the drawings. This preferred embodiment is an application of this invention to a forging press apparatus.

Figures 1, 2:
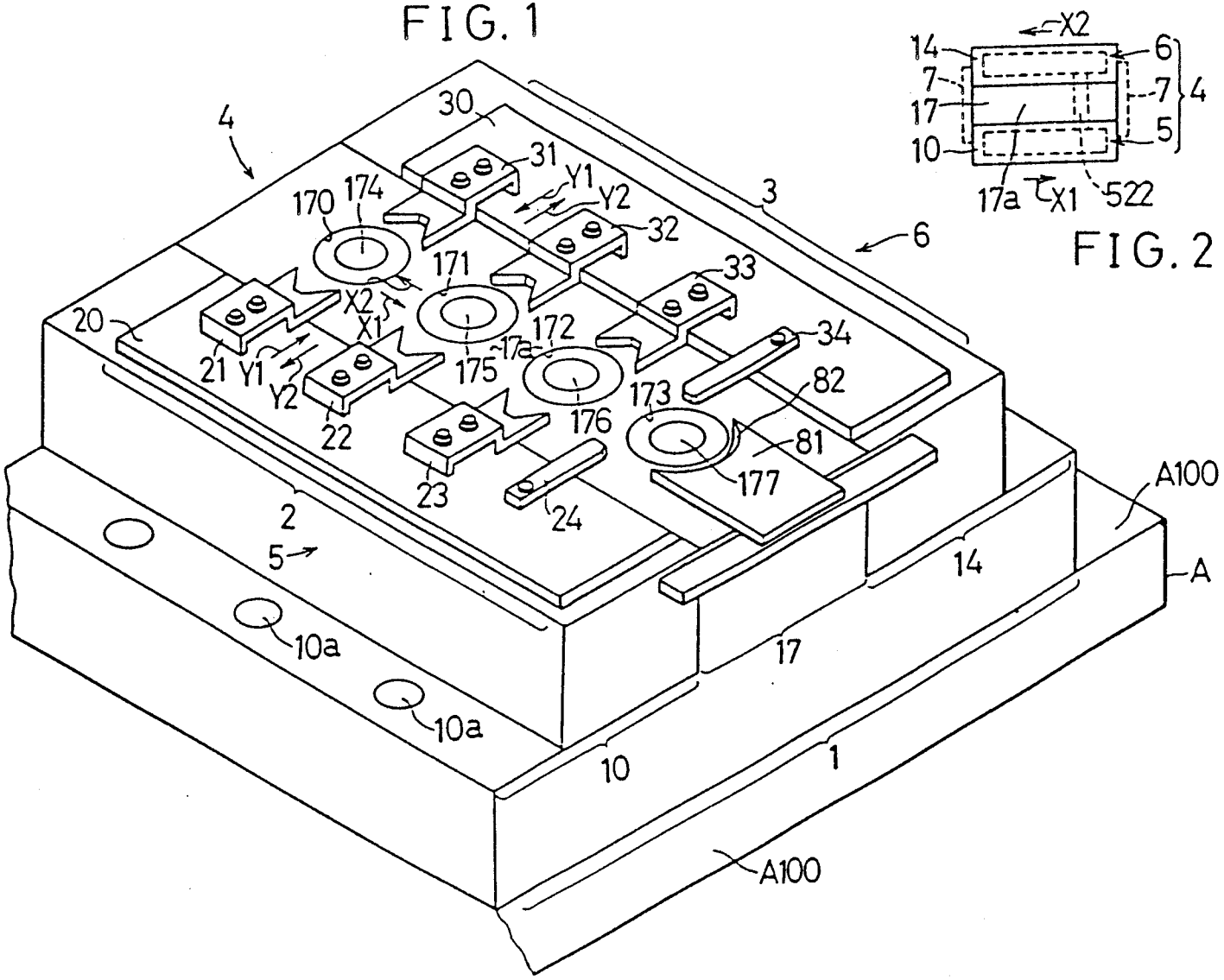
FIG. 1 is an overall perspective view of a preferred embodiment of a bolster apparatus according to this invention.
FIG. 2 is a schematic overall plan view of the preferred embodiment of the bolster apparatus according to this invention.

A bolster main body 1, a major element of the bolster apparatus, will be first described. As shown in FIG. 1, the bolster main body 1 is integrally composed of a driving bolster member 10 mounted to a bolster mounting portion "A100" of a forging press apparatus "A", a driven bolster member 14 also mounted to the bolster mounting portion "A100" of the forging press apparatus "A", and a die holding portion 17 disposed between the driving bolster member 10 and the driven bolster member 14. Here, the driving bolster member 10 is provided with mounting bores 10*a* constituting a mounting portion, and mounted detachably to the mounting portion "A100" of the forging press apparatus "A" by bolts inserted into the mounting bores 10*a*. The driven bolster member 14 is mounted to the mounting portion "A100" of the forging press apparatus "A" in a similar manner.

With reference to FIGS. 7 through 11, the driving bolster member 10 will be hereinafter described. As shown mainly in FIG. 7, the driving bolster member 10 comprises a front frame 100, main stays 101, sub-stays 102, side frames 104 fixed between the main stays 101 and sub-stays 102 by bolts 103, and a bearing case 105 fixed on the front frame 100. The side frames 104 are provided with a reinforcement pin 106 for reinforcing themselves.

Figure 13:
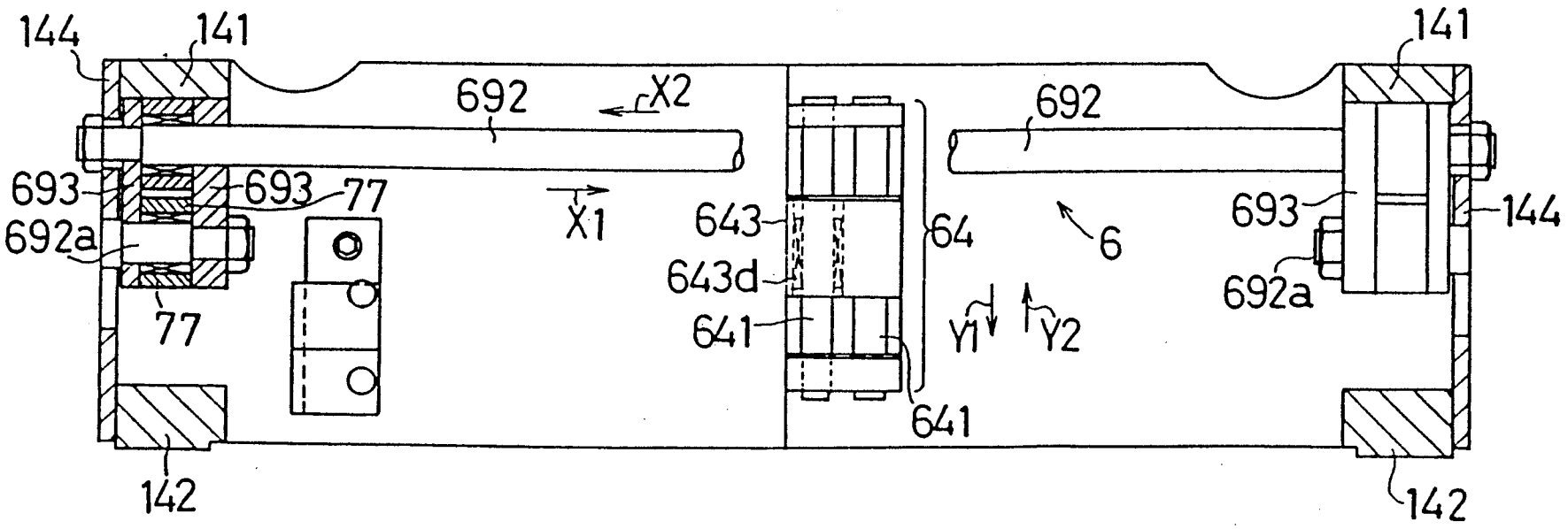
Figure 14:
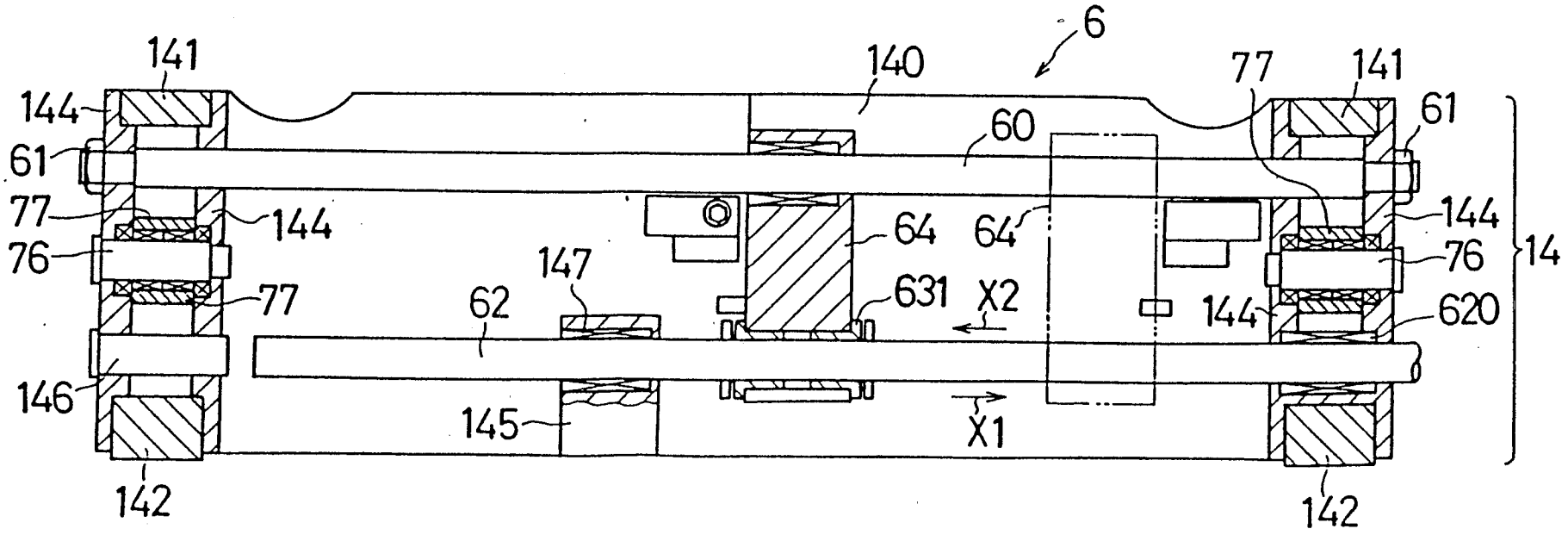

Next, with reference to FIGS. 12 through 14, the driven bolster member 14 will be hereinafter described. As shown mainly in FIG. 14, the driven bolster member 14 comprises a front frame 140, main stays 141, sub-stays 142, side frames 144 fixed between the main stays 141 and sub-stays 142 by bolts, and a bearing case 145 fixed on the front frame 140. The side frames 144 are provided with a reinforcement pin 146 for reinforcing themselves.

Then, with reference to FIGS. 1 through 3, the die holding portion 17 of the bolster main body 1 will be hereinafter described. A workpiece transfer path 17*a* of the die holding portion 17 has die holding bores 170, 171, 172 and 173 disposed in series. A crushing lower half die 174, a rough forging lower half die 175 as a first die, a finish forging lower half die 176 as a second die and a deflashing lower half die 177 as a third die are inserted into and held in the die holding bores 170, 171, 172 and 173, respectively.

The bolster main body 1 comprises a set of driving transfer claws 2 and a set of driven transfer claws 3 constituting a set of transfer claws. As shown in FIG. 1, the set of driving transfer claws 2 comprises a driving mounting plate 20 and a transfer claw 21, a first transfer claw 22, a second transfer claw 23 and a sweeper 24 as a third transfer claw, all of which are disposed on the driving mounting plate 20. The set of driven transfer claws 3 comprises a driven mounting plate 30 and a transfer claw 31, a first transfer claw 32, a second transfer claw 33 and a sweeper 34 as a third transfer claw, all of which are disposed on the driven mounting plate 30.

Figure 5:
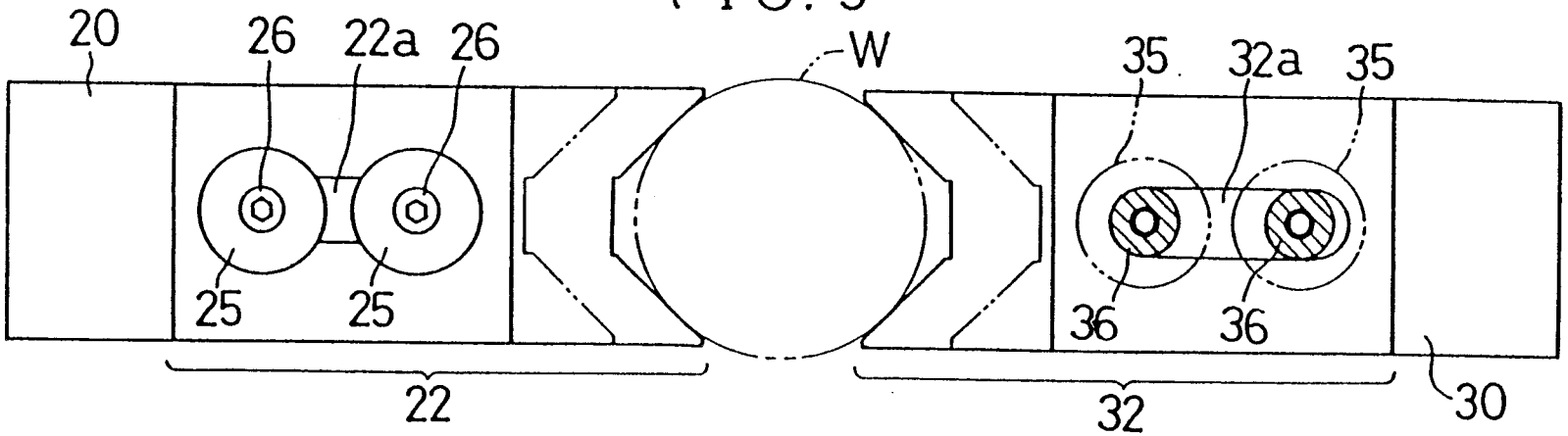
Figure 6:
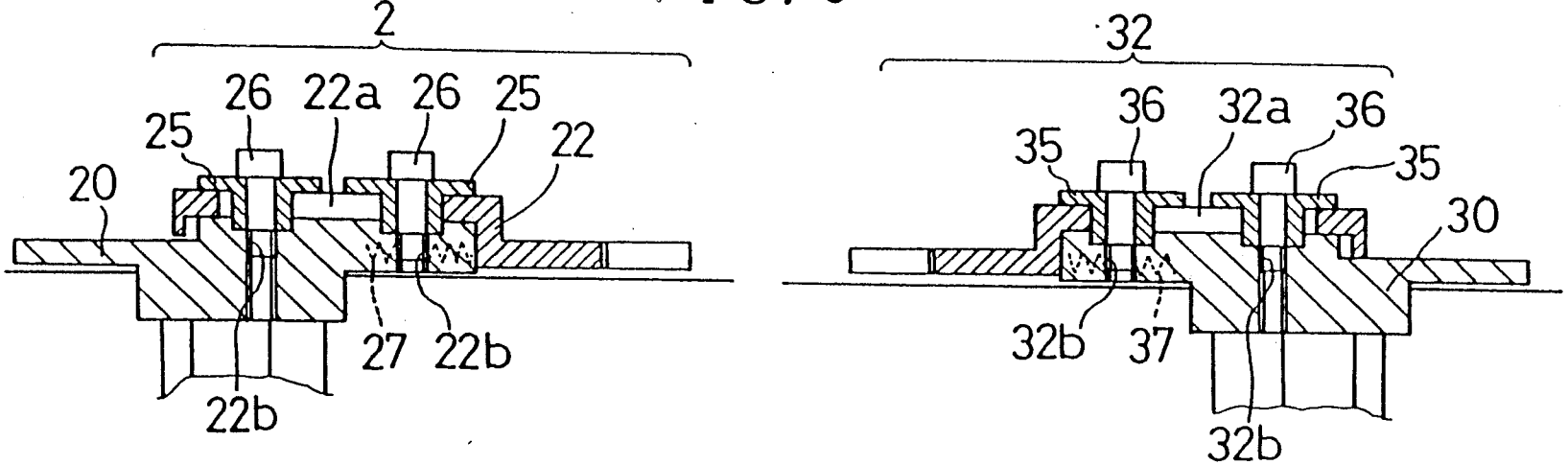

Turning now to FIGS. 5 and 6, the first transfer claws 22 and 32 will be hereinafter described. As shown in FIGS. 5 and 6, bushings 25 and 35 are inserted into holes 22*a* and 32*a* of the first transfer claws 22 and 32 respectively. Bolts 26 and 36 are inserted into the bushings 25 and 35, and screwed in threaded holes 22*b* and 32*b* of the mounting plates 20 and 30 respectively. Further, springs 27 and 37 for effecting workpiece gripping operation are interposed between the first transfer claws 22 and the mounting plate 20 and between the first transfer claw 32 and the mounting plate 30 respectively. The transfer claws 21 and 31 as well as the second transfer claws 23 and 33 have an identical construction.

The bolster main body 1 is provided with a square movement mechanism 4 for actuating the horizontal two-dimensional square movement of the set of driving transfer claws 2 and the set of driven transfer claws 3 and effecting transfer operation. The square movement mechanism 4 will be hereinafter described. As shown in FIG. 1, the square movement mechanism 4 comprises a driving mechanism 5 disposed in the driving bolster member 10, a driven mechanism 6 disposed in the driven bolster member 14 and a synchronizing mechanism 7, illustrated in FIG. 15, for synchronously transmitting the movement of the driving mechanism 5 to the driven mechanism 6.

The driving mechanism 5 will be described with reference to FIGS. 7 through 11. In FIGS. 7 through 11, the right and left direction of the drawing is taken as the X-direction, and the top and bottom direction is taken as the Y-direction. In the driving mechanism 5 illustrated in FIG. 7, a feed shaft 50 is fixed between the side frames 104 at the right and the side frames 104 at the left by bolts 51. Further, a movable feed shaft 52 is held in the side frames 104 at the right by a bearing 520 and a bearing 107 in the bearing case 105, and movable in the axial direction thereof, i.e., the directions of the arrows "X1" and "X2" in FIG. 7. A movable stand 522 is fixed to the movable feed shaft 52 at the end by a bolt 521. The movable stand 522 engages with the set of driving transfer claws 2 and the set of driven transfer claws 3, and moves the set of driving transfer claws 2 and the set of driven transfer claws 3 in the directions of the arrows "X1" and "X2". A pneumatic cylinder 53 for advancing and retracting the movable feed shaft 52 is fixed on the front frame 100 of the driving bolster member 10 by fixtures 53*a*. A cylinder rod 530 of the pneumatic cylinder 53 is connected to a X-slider 54 by a bolt 531*a* while being interposed by a connector 531, and the X-slider 54 is connected to the movable feed shaft 52 by a fixture 54*a*. An absorber stopper 55 is further connected to the X-slider 54. The absorber stopper 55 is held movably by the feed shaft 50 while being interposed by a bearing 550. When the cylinder rod 530 of the pneumatic cylinder 53 is actuated either in the direction of the arrow "X1" or in the direction of the arrow "X2", the movable feed shaft 52, the movable stand 522, the motion mixer 543 and the absorber stopper 55 are moved in the same direction. An absorber 56 is further provided for absorbing shocks when the absorber stopper 55 bumps into it.

Figure 9:
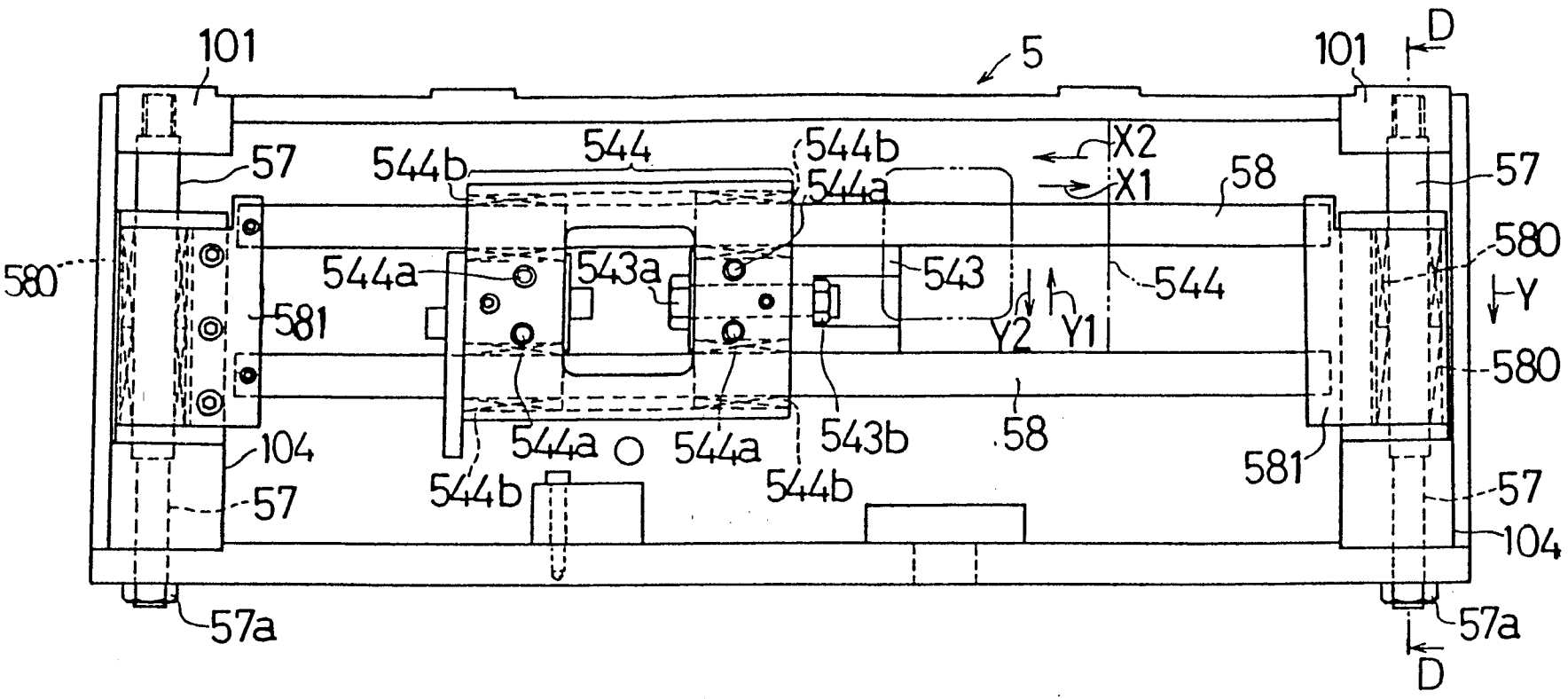

As shown in FIG. 9, guide shafts 57 are fixed parallel to the Y-direction in the side frames 104 by bolts 57*a*. Two (2) transfer shafts 58 are connected to the guide shafts 57 by way of bearings 580 and transfer shaft holders 581 in a manner extending in the direction of X-direction and bridging the guide shafts 57 at the right and left. Because the bearings 580 are guided along the guide shafts 57, the transfer shafts 58 are movable in the length direction of the guide shafts 57, i.e., in the Y-direction.

Figure 8:
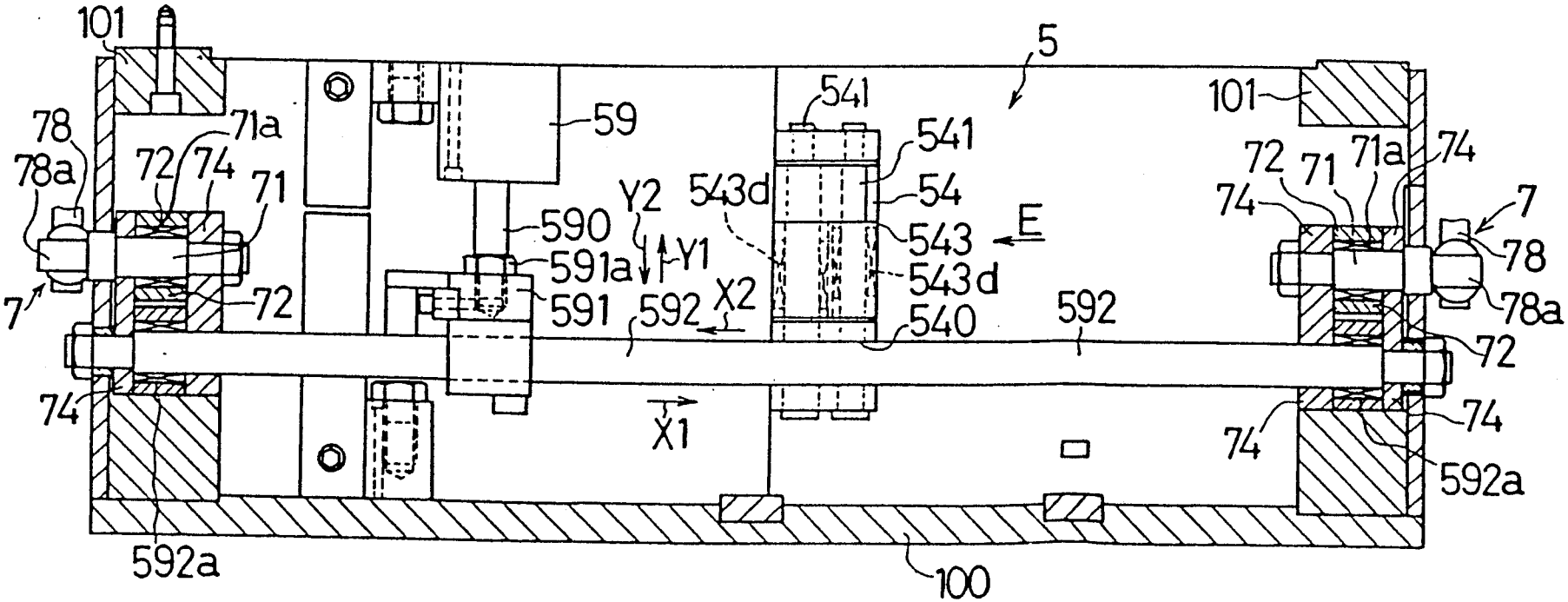

Turning now to FIG. 8, a pneumatic cylinder 59 for opening and closing, i.e., a driver for effecting the movements in the Y-direction, is fixed on the front frame 100 of the driving bolster member 10. The pneumatic cylinder 59 is incorporated into the bolster main body 1 in addition to the pneumatic cylinder 53, because this preferred embodiment features the square movement mechanism 4 incorporated into the bolser main body 1. This arrangement is advantageous for down-sizing the overall apparatus when compared with a bolster main body 1 into which a motor mechanism is incorporated.

Figure 7:
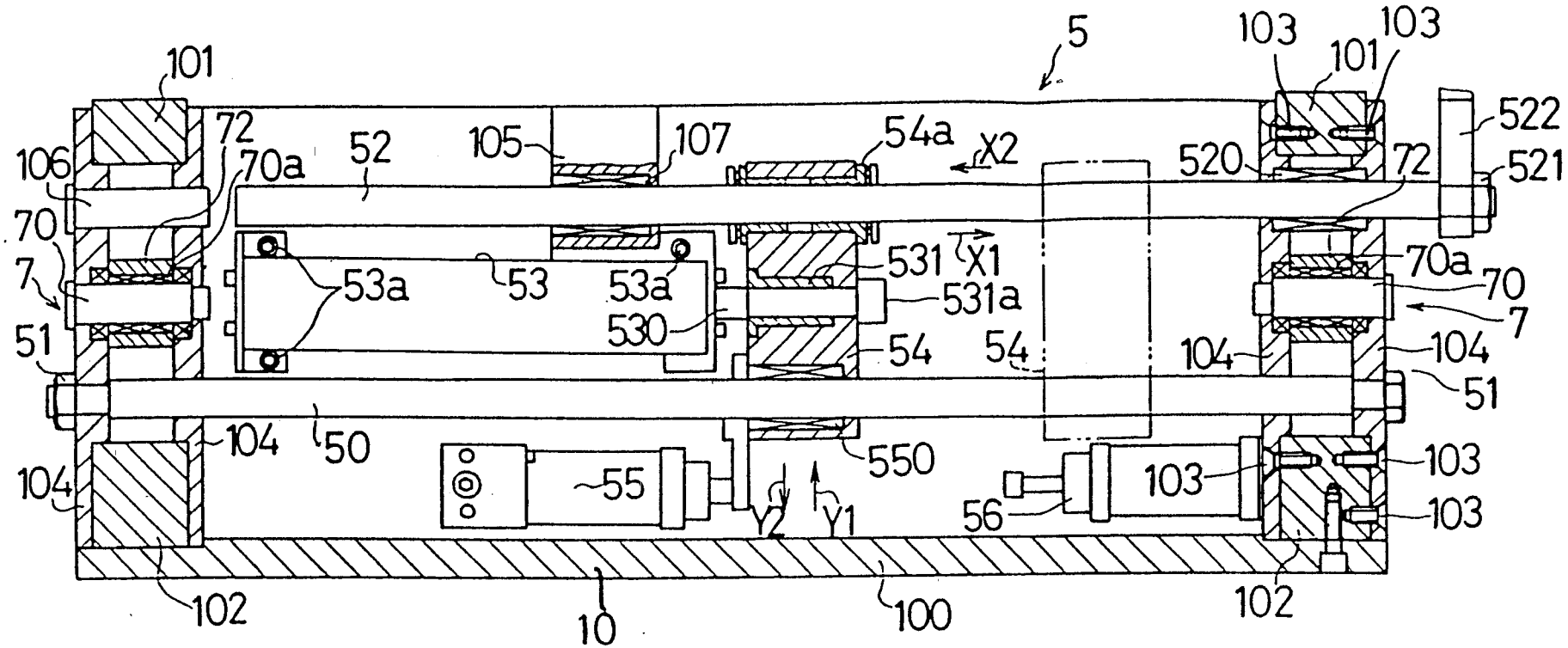
Figure 10:
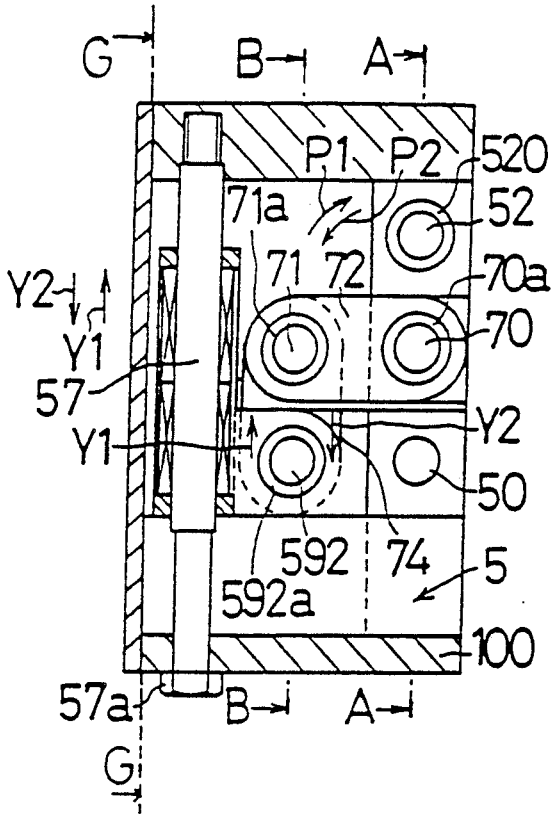
Figure 11:
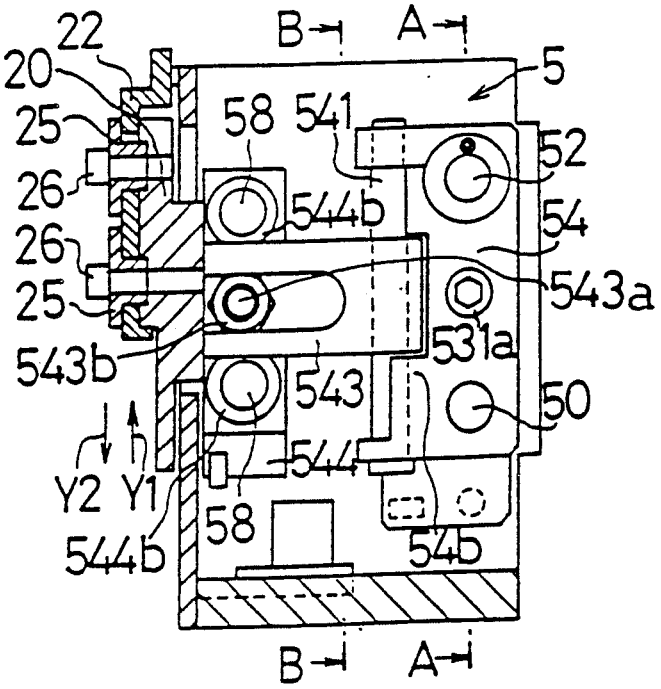
Figure 20:
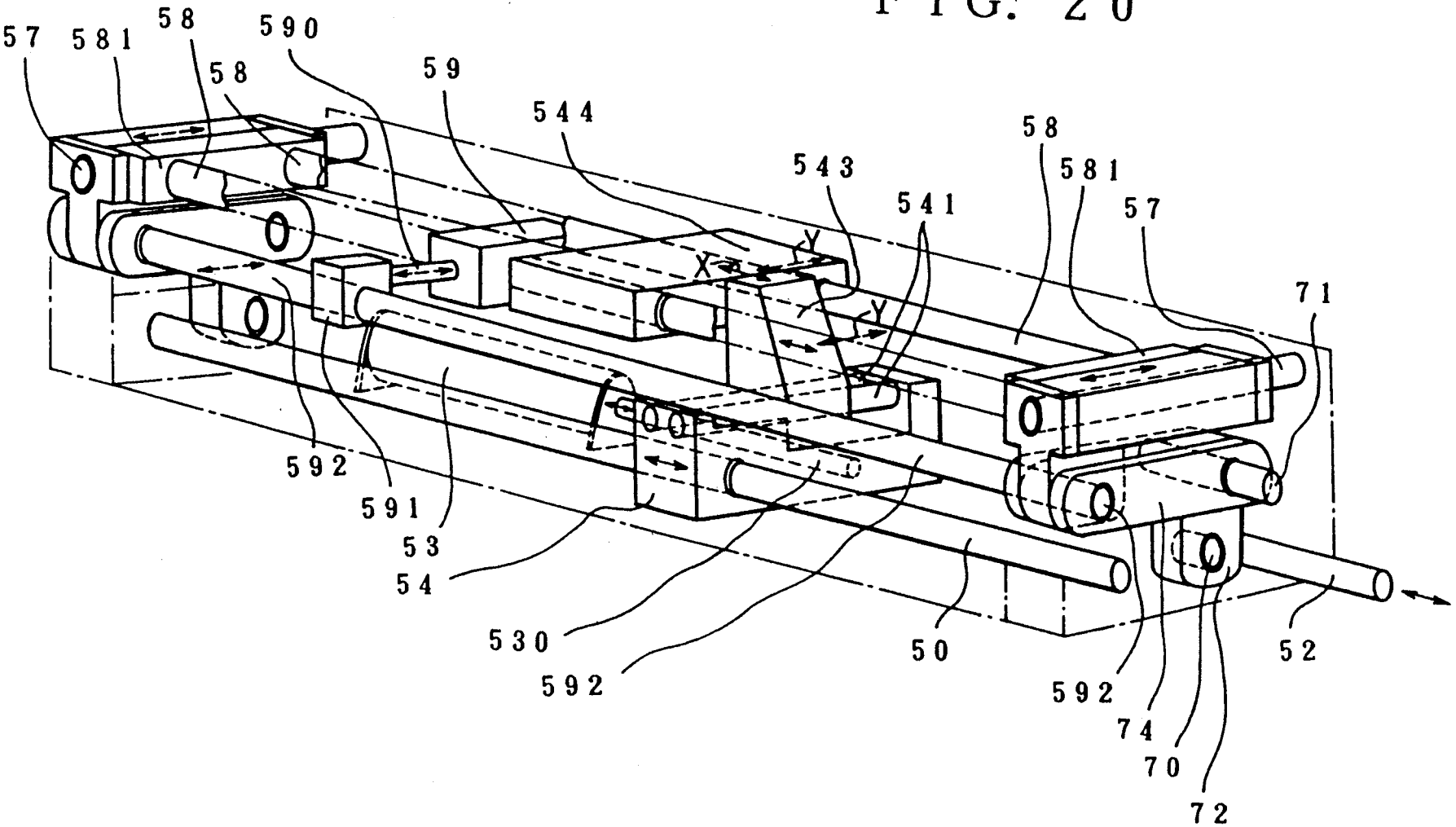
FIG. 20 is a perspective view of the apparatus showing the relationship between the principal parts of the apparatus.

A cylinder rod 590 of the pneumatic cylinder 59 is connected to a link driving shaft 592 by a bolt 591*a* while being interposed by a connector 591. The link driving shaft 592 is inserted into a holding bore 540 of the motion mixer 543, and the motion mixer 543 is held substantially at the center of the link driving shaft 592. When the link driving shaft 592 is moved either in the direction of the arrow "Y1" or in the direction of the arrow "Y2", the motion mixer 543 can be moved accordingly. This is also shown in FIG. 20, which illustrates that the link driving shaft 592 and the motion mixer 543 both move in the Y direction. X-slider 54 moves in the X direction. When shaft 592 moves in direction Y1, shown in FIG. 10, link plate 74 and link pin 71, move in direction Y1, and link plate 72 swings around link pin 70 in the direction of arrow P1. When link plate 74 moves in the direction of arrow Y1, transfer shaft holder 581 moves in the direction of arrow Y1 along guide shaft 57. Transfer shaft holder 581 is connected to link plate 74 and, in FIG. 9, transfer shaft 58 is connected to transfer shaft holder 581. Accordingly, transfer shaft 58 moves in the direction of arrow Y1. Further, as shown in FIG. 11, motion mixer 543 moves along shaft 541 in the direction of arrow Y1. X-slider 54 can be moved along feed shaft 50 in the direction of arrows X1 and X2 but X-slider 54 cannot be moved in the direction of arrows Y1 and Y2 shown in FIG. 11, because feed shaft 50 is fixed to side frame 104, as shown in FIG. 7.

As shown in FIGS. 8 and 11, two (2) shafts 541 are disposed in the X-slider 54 in a manner extending in the Y-direction. A motion mixer 543 is held by the shafts 541 while being interposed by bearings 543*d*. As shown in FIGS. 9 and 11, a transfer base 544 is further fixed to the motion mixer 543 by a bolt 543*a* and a nut 543*b*. The mounting plate 20 of the set of driving transfer claws 2 are fixed to the transfer base 544 by bolts assembled in mounting holes 544*a* of the transfer base 544. Because bearings 544*b* of the transfer base 544 is slidable along the transfer shafts 58, the transfer base 544 is movable along the transfer shafts 58 in the X-direction.

Turning back to FIG. 8, when the cylinder rod 590 of the pneumatic cylinder 59 retracts in the direction of the arrow "Y1" in the drawing, the link driving shaft 592 move in the direction of the arrow "Y1". The motion mixer 543 moves along guide shafts 541 in the direction of arrow Y1. Whereby the set of driving transfer claws 2 held to the transfer base 544 moves in the direction of the arrow "Y1", namely in the direction closing thereof. At this moment, as readily understood from FIG. 9, the bearings 580 are guided along the guide shafts 57, thereby moving the transfer shafts 58 and the transfer base 544 along the guide shafts 57 in the direction of the arrow "Y1".

The driven mechanism 6 of the square movement mechanism 4 will be hereinafter described with reference to FIGS. 12 through 14. The driven mechanism 6 is disposed in the driven bolster member 14, and has a mechanism basically identical with that of the above-mentioned driving mechanism 5 disposed in the driving bolster member 10. However, the driven mechanism 6 differs from the driving mechanism 5 in that no pneumatic cylinder 53 for advancing and retracting and pneumatic cylinder 59 constituting the drivers are provided in the driven mechanism 6.

Hereinafter, the driven mechanism 6 of the square mechanism 4 will be described in detail. As shown in FIG. 14, a feed shaft 60 is fixed between the side frames 144 at the right and the side frames 144 at the left by bolts 61. Further, a movable feed shaft 62 is held in the side frames 144 at the right by a bearing 620 and a bearing 147 in the bearing case 145, and movable in the axial direction thereof, i.e., the directions of the arrows "X1" and "X2" in FIG. 14. A X-slider 64 is fixed to the movable feed shaft 62 while being interposed by a connector 631. The end of the movable feed shaft 62 is connected to the above-mentioned movable stand 522. Consequently, when the movable feed shaft 52 of the driving mechanism 5 moves in the X-direction to move the movable stand 522 in the X-direction, the movable shaft 62 moves synchronously. Further, as shown in FIG. 13, two (2) shafts 641 are disposed in the X-slider 64 in a manner extending in the Y-direction. A motion mixer 643 is held by the shafts 641 while being interposed by bearings 643*d*. As shown in FIGS. 12, a transfer base 644 is further fixed to the motion mixer 643 by a bolt 643*a* and a nut 643*b*. The mounting plate 30 of the set of driven transfer claws 3 are fixed to the transfer base 644 by bolts assembled in mounting holes 644*a* of the transfer base 644.

Figure 12:
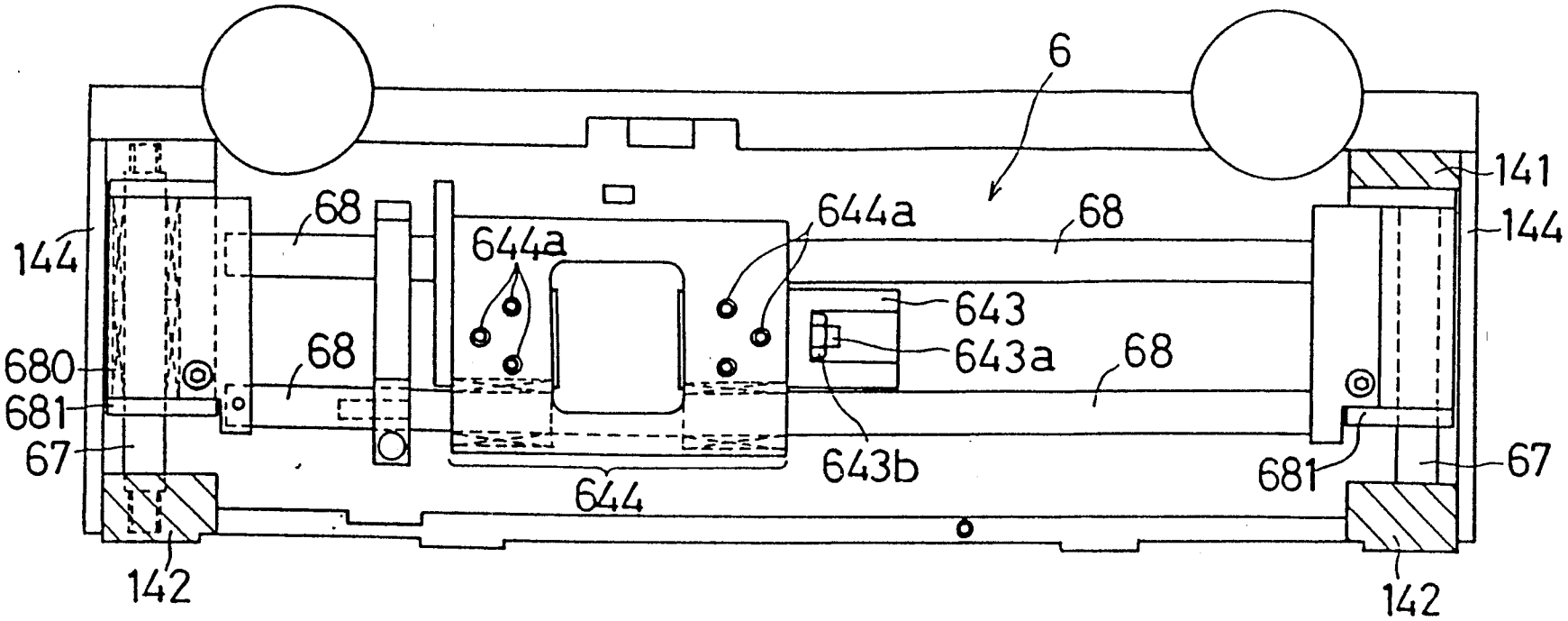

Moreover, as shown in FIG. 12, guide shafts 67 are fixed parallel to the Y-direction in the side frames 144. Two (2) transfer shafts 68 are connected to the guide shafts 67 by way of bearings 680 and transfer shaft holders 681 in a manner extending in the direction of X-direction and bridging the guide shafts 67 at the right and left. The transfer shafts 68 are movable in the length direction of the guide shafts 67, i.e., in the Y-direction. Turning now to FIG. 13, a link driving shaft 692 is inserted into a holding bore of the motion mixer 643, and the motion mixer 64 is held substantially at the center of the link driving shaft 692. When the link driving shaft 692 is moved either in the direction of the arrow "Y1" or in the direction of the arrow "Y2", the motion mixer 643 can be moved accordingly.

Figure 15:
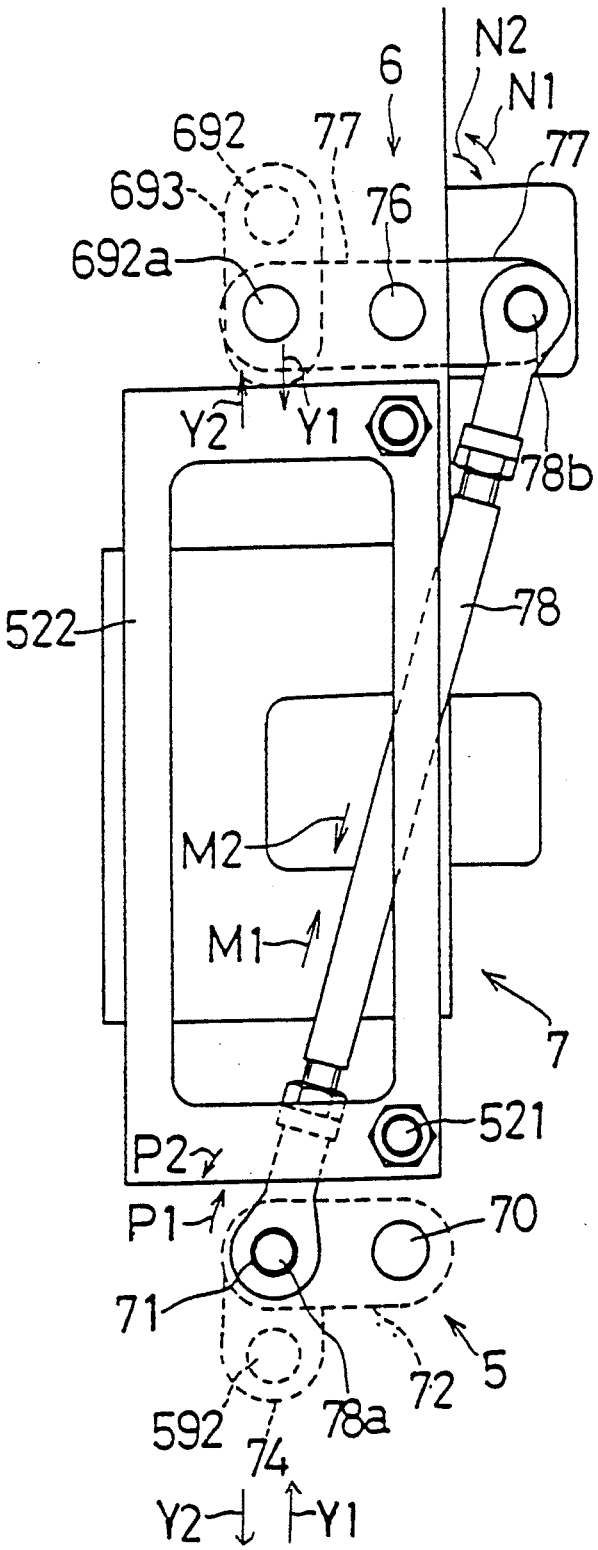
FIG. 15 is a side view illustrating a synchronizing mechanism of the preferred embodiment of the bolster apparatus according to this invention.

Next, the synchronizing mechanism 7 for synchronizing the driving mechanism 5 with the driven mechanism 6 will be hereinafter described As shown in FIG. 8, two (2) synchronizing mechanisms 7 are disposed in the bolster main body 1 at the right and left ends of the X-direction thereof for securing synchronizing performance. In the driving bolster member 10, as shown in FIGS. 7, 8 and 10, the synchronizing mechanisms 7 comprise link pins 70 and engaging with the side frames 104, link plates 72 swingably held by the link pins 70 and 71, and link plates 74 swingably held by the link pins 71 and the link driving shaft 592. In the driven bolster member 14, as shown in FIG. 15, the synchronizing mechanisms 7 further comprise link plates 77 held swingably by link pins 76 at the center thereof and held by link pins 692*a* at one end thereof, link plates 693 connecting the link pins 692*a* and the link driving shaft 692, and synchronizing shafts 78 connecting the driving link plates 72 and the driven link plates 77 by pins 78*a* and 78*b*. In FIGS. 7 through 10, reference numbers 70*a*'s, 71*a*'s and 592*a*'s specify bearings.

As understood from FIG. 8, when the cylinder rod 590 of the above-mentioned pneumatic cylinder 59 moves in the direction of the arrow "Y1" to move the link driving shaft 592 in the same direction, the motion mixer 543 move in the direction of the arrow "Y1". Whereby the mounting plate 20 of the set of driving transfer claw 2, the transfer claws 21, 22 and 23 and the sweeper 24 of the set of driving transfer claws 2 are moved in the direction of the arrow "Y1". Turning now to FIG. 10, when the link driving shaft 592 moves in the direction of the arrow "Y1", the link plates 72 are pressed by way of the link driving shaft 592, the link plates 74 and the link plates 71. Whereby the link plates 72 swing around the link pins 70 in the direction of the arrow "P1" shown in FIG. 10. Consequently, as shown in FIG. 15, the synchronizing shafts 78 operate in the direction of the arrow "M1", and the link pins 77 of the driven mechanism 6 accordingly swing in the direction of the arrow "N1". Whereby the link driving shaft 692 is moved in the direction of the arrow "Y1" shown in FIG. 15. As a result, the mounting plate 30 of the the set of driven transfer claws 3, the transfer claws 31, 32 and 33 and the sweeper 34 of the set of driven transfer claws 3 are moved in the direction of the arrow "Y1". Thus, it is apparent from FIG. 1 that the set of driving transfer claws 2 and the set of driven transfer claws 3 move in the closing direction when the pneumatic cylinder 59 operates.

Figure 3:
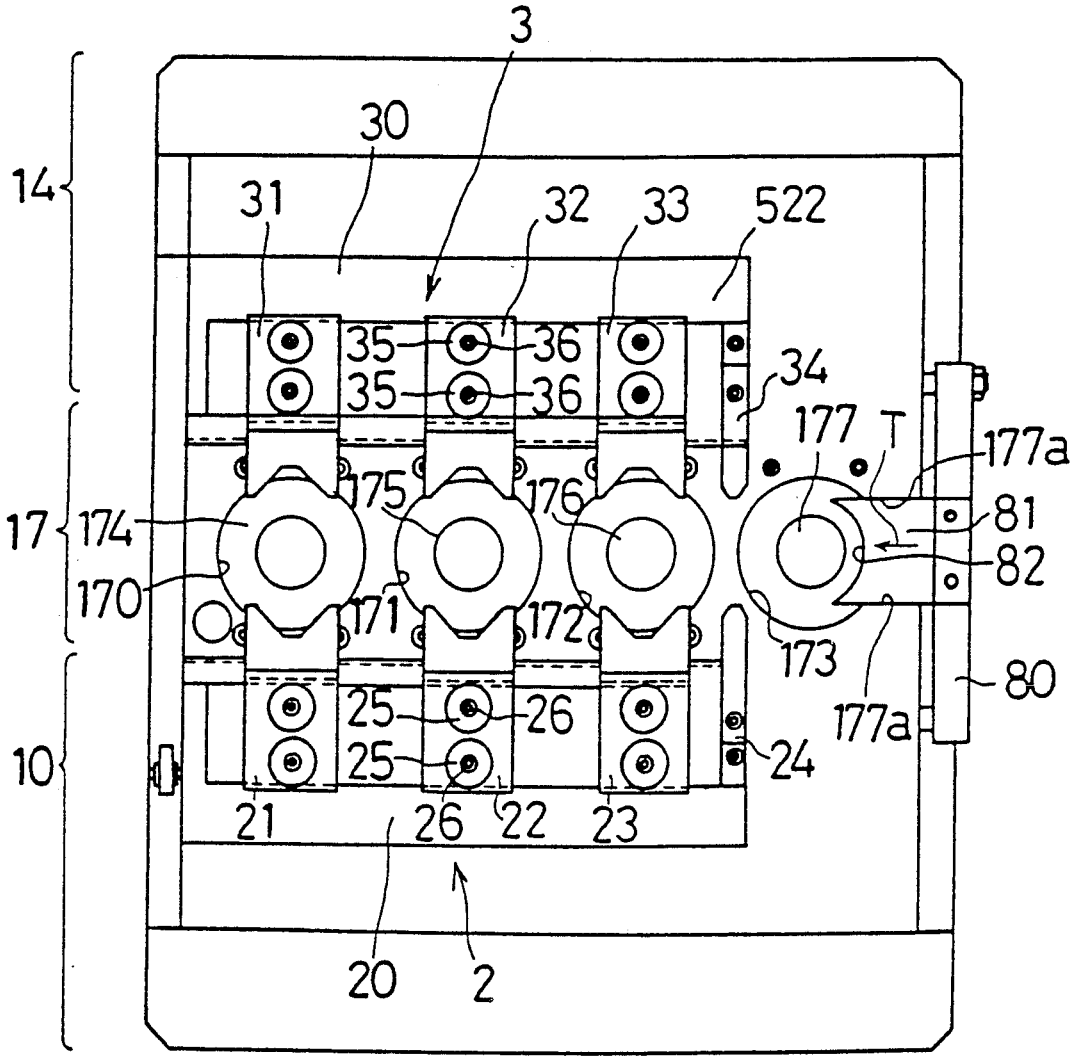
FIG. 3 is a plan view illustrating sets of transfer claws of the preferred embodiment of the bolster apparatus according to this invention.
Figure 16:
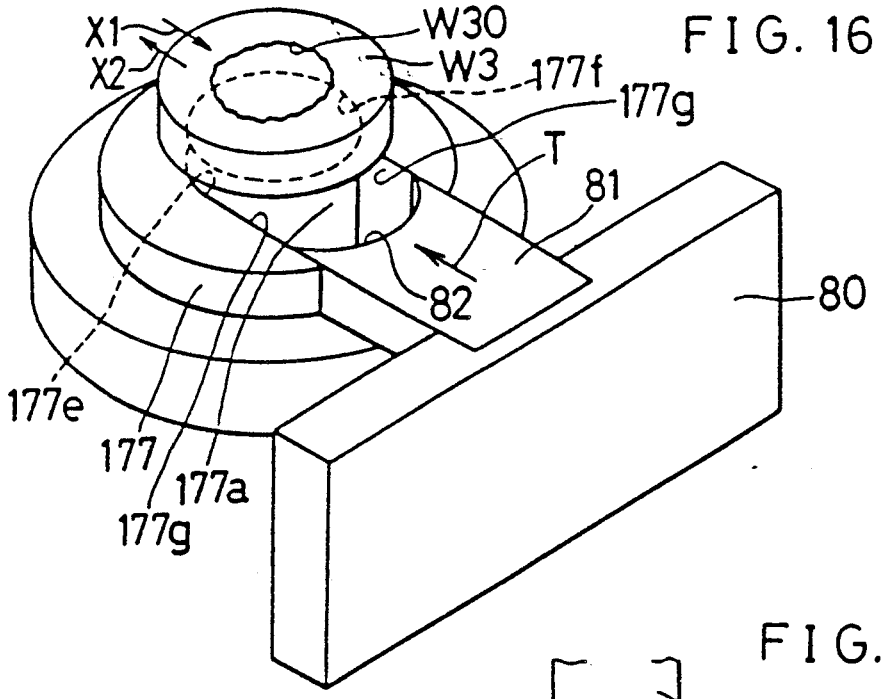
FIG. 16 is a perspective view of a major portion of the preferred embodiment of the bolster apparatus according to this invention for deflashing operation.

In this preferred embodiment, as shown in FIG. 3, a die mounting member 80 is fixed to the movable stand 522 and is movable in the X-direction and a clamping die 81 is fixed to the die mounting member 80. As shown in FIGS. 3 and 16, a clamping surface 82 for clamping a finish forged product W3, one of workpieces is formed on the the clamping die 81 in a semicircular arc shape. Further, a guide bore 177*a* is formed on the deflashing lower half die 177, and the clamping die 81 is slidable on the wall surface of the guide bore 177*a* in the direction of the arrow "T".

Figure 4:
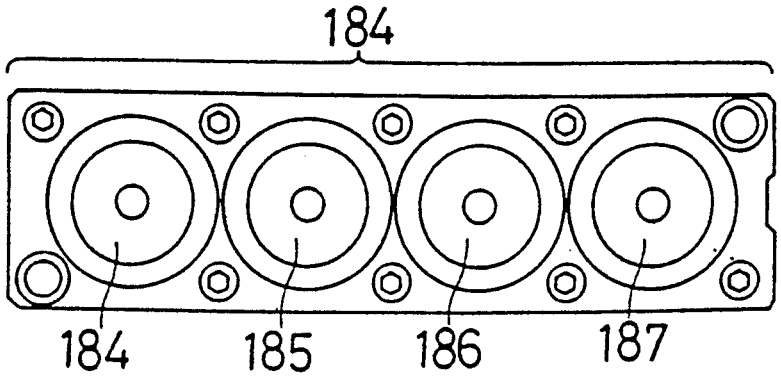
FIG. 4 is a bottom view illustrating a set of a crushing upper half die, a rough forging upper half die, a finish forging upper half die and a deflashing upper half die of the preferred embodiment of the bolster apparatus according to this invention.
Figure 18:
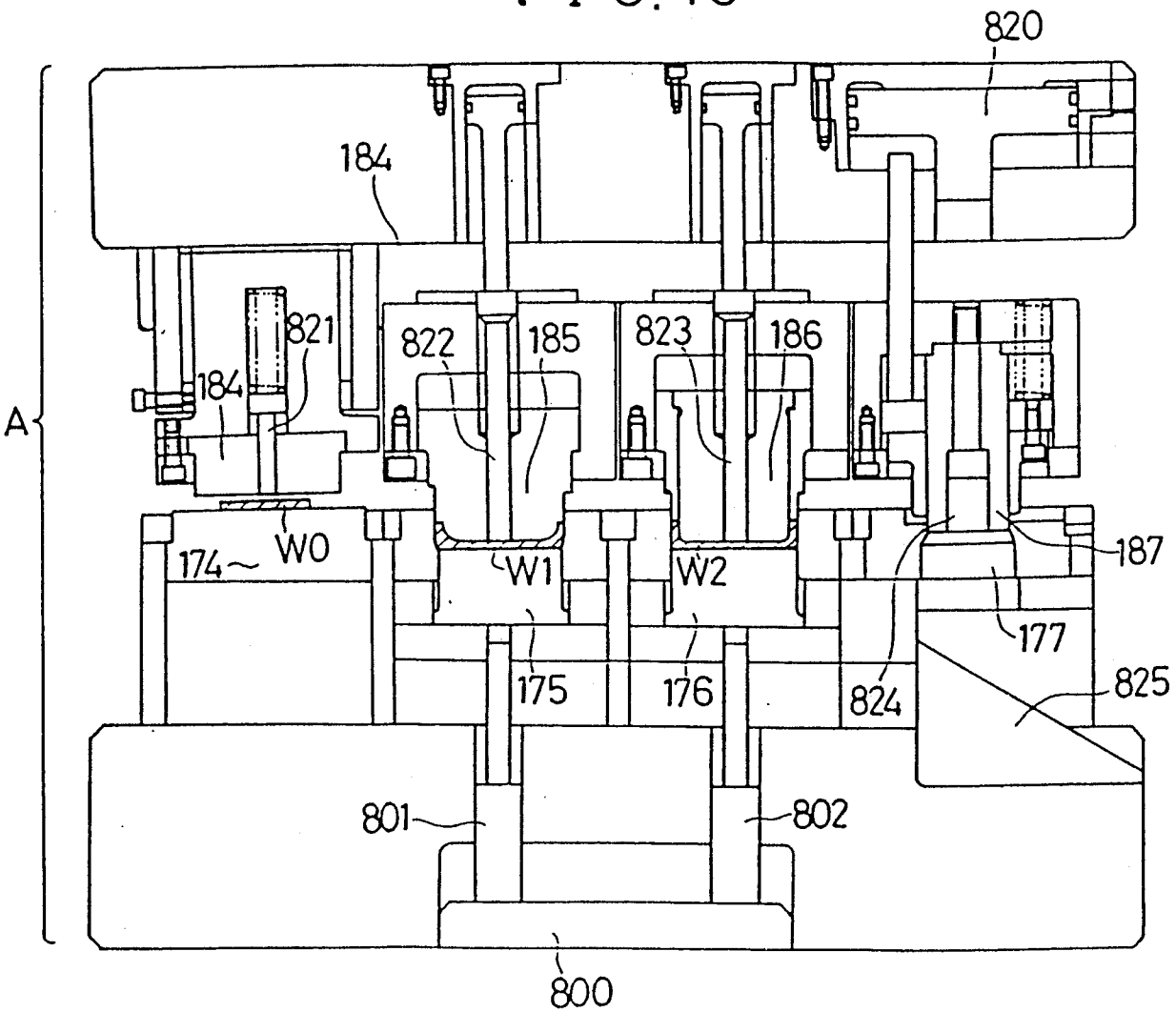
FIG. 18 is a cross-sectional view of the preferred embodiment of the bolster apparatus according to this invention incorporated into a forging press apparatus.

Lastly, the forging press apparatus "A" to which the above-mentioned bolster apparatus of this preferred embodiment is mounted will be described with reference to FIG. 18. As shown in FIG. 18, the forging press apparatus "A" comprises a lower member provided with a knock-out piston 800, knock-out pins 801 and 802, and an upper member provided with a knock-out plate 820, knock-out pins 821, 822, 823 and 824, and a chute 825. As shown in FIG. 4, in the forging press apparatus "A" to which the bolster apparatus of this preferred embodiment is mounted, an upper bolster apparatus 184 is further provided in which a crushing upper half die 184, a rough forging upper half die 185, a finish forging upper half die 186 and a deflashing upper half die 187 are attached.

The bolster apparatus of this preferred embodiment described above are operated as follows. First, the forging press apparatus "A" is actuated with the following set-up as shown in FIG. 18: a workpiece W0 is placed in the crushing lower half die 174, a crushed workpiece W1 which has been crushed and deformed by the crushing lower half die 174 and the crushing upper half die 184 is placed in the rough forging lower half die 175, and a rough forged product W3 which has been molded by the rough forging lower half die 175 and the rough forging upper half die 185 is placed in the finish forging lower half die 176. Accordingly, the workpiece W0 is crushed by the crushing lower half die 174 and the crushing upper half die 184, the crushed workpiece W1 is rough-forged to a rough forged product W2 by the rough forging lower half die 175 and the rough forging upper half die 185, the rough forged product W2 is finish-forged to a finish forged product W3 by the finish forging lower half die 176 and the finish forging upper half die 186, and the finish forged product W3 is deflashed by the deflashing lower half die 177 and the deflashing upper half die 187.

When the crushing upper half die 184, the rough forging upper half die 185, the finish forging upper half die 186 and the deflashing upper half die 186 move upward, the cylinder rod 590 of the pneumatic cylinder 59 of the square movement mechanism 4 for opening and closing, i.e., the Y-direction transfer, operates in the direction of the arrow "Y1" to move the link driving shaft 592, the motion mixer 543 in the direction of the arrow "Y1" as shown in FIG. 8. Whereby the set of driving transfer claws 2 is moved in the direction of the arrow "Y1" as shown in FIG. 11. At this moment, the link pins 71 and the link plates 74 move in the direction of the arrow "Y1" as shown in FIG. 10 in accordance with the movement of the link driving shaft 592 in the arrow "Y1". The link plates 72 swing around the link pins 70 in the direction of the arrow "P1" as shown in FIG. 10. As a result, as shown in FIG. 15, the synchronizing shafts 78 move in the direction of the arrow "M1", the link plates 77 swing around the link pins 76 in the direction of the arrow "N1", and the driven link pins 692*a* and the link driving shaft 692 move in the direction of the arrow "Y1" (see FIG. 13.). Whereby the set of driven transfer claws 3 is moved in the direction of the arrow "Y1" (see FIG. 1.). Thus, the set of driving transfer claws 2 and the set of driven transfer claws 3 close. Whereby the transfer claws 21 and 31 hold the crushed workpiece W1, the first transfer claws 22 and 32 hold the rough forged product W2, and the second transfer claws 23 and 33 hold the finish forged product W3.

While holding the workpieces W1 through W3, the cylinder rod 530 of the pneumatic cylinder 53 for advancing and retracting, i.e., the X-direction transfer, operates to move the motion mixer 543 at the position specified by the alternate long and two dashes lines in FIG. 7. The transfer base 544 accordingly advances in the direction of the arrow "X1", and the movable stand 522 fixed at the end of the movable feed shaft 52 advances in the same direction. Whereby the set of driving transfer claws 2 and the set of driven transfer claws 3 engaging with the movable stand 522 by way of the mounting plates 20 and 30 are advanced in the direction of the arrow "X1". When the set of driving transfer claws 2 and the set of driven transfer claws 3 reach the advance-end thereof, the pneumatic cylinder 59 for opening and closing therefor actuate to extend the cylinder rod 590 in the direction of the arrow "Y2" as shown in FIG. 8. The link driving shaft 592 and the motion mixer 543 move in the direction of the arrow "Y2". When the link driving shaft 592 moves in the direction of the arrow "Y2" and the transfer base 544 moves in the same direction therewith, the set of the driving transfer claws 2 is opened consequently.

Further, when the link driving shaft 592 moves in the direction of the arrow "Y2", as can be readily understood from FIG. 10, the link plates 74 and link pins 71, shown in FIG. 10, move in the direction of the arrow "Y2" to swing the link plates 72 around the link pins 70 in the direction of the arrow "P2". As a result, as shown in FIG. 15, the synchronizing shafts 78 operate in the direction of the arrow "M2" to swing the driven link plates 77 around the link pins 76 in the direction of the arrow "N2". The link driving shaft 692 in the driven bolster member 14 consequently moves in the direction of the arrow "Y2" shown in FIG. 15. Whereby the set of the driven transfer claws 3 is opened in the direction of the arrow "Y2". Thus, the set of the driving transfer claws 2 and the set of the driven transfer claws 3 are opened.

In the above-mentioned manner, the transfer claws 21 and 31 release the crushed workpiece W1, the first transfer claws 22 and 32 release the rough forged product W2, and the second transfer claws 23 and 33 release the finish forged product W3. As a result, the crushed workpiece W1, the rough forged product W2 and the finish forged product W3 are advanced by a predetermined pitch, i.e., the stroke-length of the pneumatic cylinder 53 for the X-direction transfer, and transferred to the subsequent processing positions.

When the workpieces W1 through W3 are thus advanced, the forging press apparatus "A" actuates to move the crushing upper half die 184, the rough forging upper half die 185, the finish forging upper half die 186 and the deflashing upper half die 187 downward. Accordingly, the crushed workpiece W1 is rough-forged to a rough forged product W2, the rough forged product W2 is finish-forged to a finish forged product W3, and the finish forged product W3 is deflashed.

Figure 17:
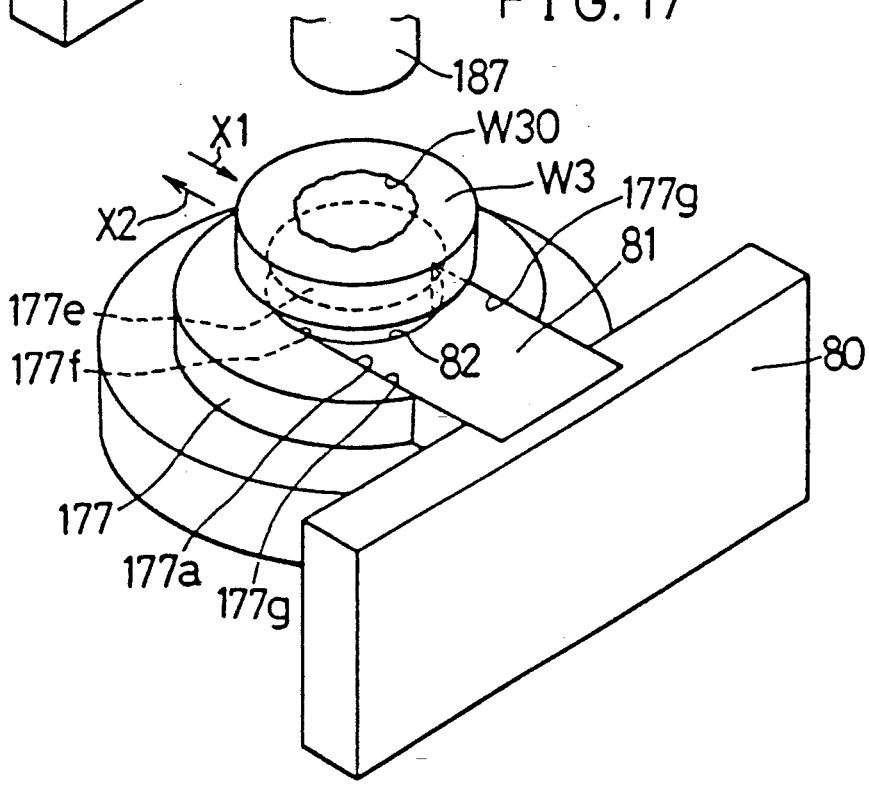
FIG. 17 is also a perspective view of the major portion thereof for deflashing operation.

In the deflashing performance, as shown in FIG. 16, the clamping surface 82 of the clamping die 81 is away from the deflashing lower half die 177 when the set of driving transfer claws 2 and the set of driven transfer claws 3 are moving in the direction of the arrow "X1". In this situation, the finish forged product W3 are held and transferred by the second transfer claw 23 of the set of driving transfer claws 2 and the second transfer claws 33 of the set of driven transfer claws 3, and placed in the cavity of the deflashing lower half die 177. Thereafter the set of driving transfer claws 2 and the set of driven transfer claws 3 are retracted in the direction of the arrow "X2", the clamping die 81, interlocking with the set of driving transfer claws 2 and the set of driven transfer claws 3, is moved accordingly in the direction of the arrow "T" shown in FIG. 16. Whereby the clamping surface 82 of the clamping die 81 is brought into contact with the peripheral wall surface of the finish forged product W3. As shown in FIG. 17, the finish forged product W3 is thus clamped by the clamping surface 82 of the clamping die 81 and the cavity surface of the deflashing lower half die 177. While holding the finish forged product W3 in this manner, the deflashing upper half die 187 is moved downward to deflash the central bore W30 of the finish forged product W3. After deflashing, the sweepers 24 and 34 put into the closing state are advanced in the direction of the arrow "X1", thereby discharging the deflashed finish forged product W3 out to the chute 825 through a guide bore 177*a*.

By the way, many workpieces should be processed when producing various products by the small lot. Accordingly, various bolster main bodies 1 exclusively for the various products are prepared depending on the types of workpieces. When changing a production set-up for a product to the other production set-ups for the other products, as shown in FIG. 1, the bolts inserted into the the mounting bores 10*a* are first removed, and a bolster main body 1 is detached from the bolster mounting portion "A100" of the forging press apparatus "A". Then, the driving mechanism 5 and the driven mechanism 6 of the square movement mechanism 4 constituting the transfer are also detached automatically. Next, another driving bolster member 10 and driven bolster member 14 exclusively for another product are mounted to the bolster mounting portion "A100" of the forging press apparatus "A". Then, another driving mechanism 5 and the driven mechanism 6, constituting another square mechanism 4 and being exclusively for another product, are attached automatically. Thus, square movement mechanisms 4 can be exchanged automatically by exchanging the bolster main bodies 1. After the exchanging, the forging press "A" is operated to perform another series of press forming processes to forge and produce the another product.

It is understood from the above description that the process for press-forming workpieces according to this preferred embodiment is advantageous when producing various products by the small lot, because the square movement mechanisms 4 constituting transfers can be exchanged automatically by exchanging the bolster apparatuses. It is also understood that the bolster apparatus according to this preferred embodiment has enabled the above-mentioned process for pressing workpieces.

Figure 19:
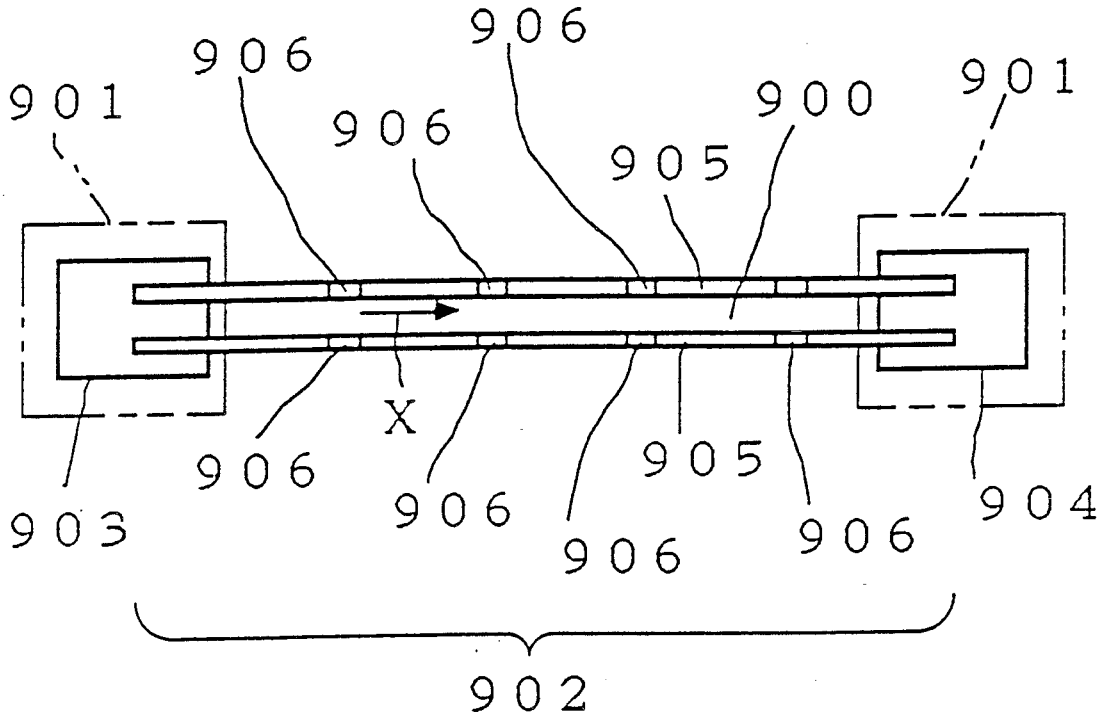
FIG. 19 is a schematic plan view of a conventional transfer.

On the other hand, in the conventional transfer mechanisms illustrated in FIG. 19, it is a usual arrangement that the driving mechanism 903 of the square movement mechanism 902 is disposed at one end of the workpiece advancement direction, i.e., at one end of the X-direction, and that the driven mechanism 904 of the square movement mechanism 902 is disposed at the other end of the workpiece advancement direction. In the conventional transfer mechanisms, it is inevitable that the length of rods 905 connecting the driving mechanism 903 and the driven mechanism 904 increases, and that the inertia masses and inertia forces thereof tend to increase in accordance with the increasing rod 905 length. Consequently, the structures of the rods 905 and the bolster apparatus should be highly strengthened and rigidified. In view of this, as shown in FIG. 1, this preferred embodiment has the driving mechanism 5 disposed at one end of the Y-direction which intersects the workpiece W transfer direction (the X-direction), and the driven mechanism 6 disposed at the other end of the Y-direction. Whereby the inertia masses and inertia forces thereof can be reduced effectively, and the structures of the square movement mechanism 4 and the bolster main body 1 can be simplified effectively.

The above-mentioned preferred embodiment is an example applied to a forging press process, but can be applied to a sheet metal press process, a deep drawing process and so on. Further, the bolster apparatus according to this invention is not limited to the preferred embodiment described above and illustrated in the drawings.

Having now fully described the invention, it will be apparent to one of ordinary skill in the art that many changes and modifications can be made thereto without departing from the spirit or scope of the invention as set forth herein.

What is claimed is:

1. A bolster apparatus comprising:

a bolster main body comprising a die holding portion;

at least two dies disposed in a manner neighboring in series in the X-direction; and a transfer claw assembly disposed advanceably and retractably in the X-direction, whereby formed products are transferred from one of said dies to a neighboring die during the advancement thereof;

wherein at least one of said dies comprises a die main body comprising a cavity for forming said formed products, a first die surface defining said cavity, a guide bore opening in the X-direction and communicating said cavity with the outside and a guide surface defining said guide bore; and a separable die comprising a second die surface connected to said transfer claw assembly advanceably and retractably in the X-direction in a manner synchronizing with said transfer claw assembly, wherein said second die surface moves in the X-direction away from said cavity during one cycle of the advancement and the retraction of said transfer claw assembly, and said second die surface moves in the X-direction in a manner being guided by said guide surface of said guide bore, approaches the said cavity and fits in said die main body during the other one of the advancement and the retraction of said transfer claw assembly.

2. A bolster apparatus comprising:

a driving bolster member comprising a plurality of driving workpiece transfer claws, said plurality of driving workpiece transfer claws disposed movably both in the Y-direction and in the X-direction taken perpendicularly to the Y-direction;

a driven bolster member disposed in the Y-direction with respect to the driving bolster member and comprising a plurality of driven workpiece transfer claws, said plurality of driven workpiece transfer claws disposed movably in the Y-direction and the X-direction;

a die holding portion capable of holding a plurality of dies disposed in series, said die holding portion disposed between said driving bolster member and said driven bolster member;

wherein at least one of said plurality of dies comprises:

a die main body comprising a cavity for forming workpieces, a first die surface defining said cavity, a guide bore opening in the X-direction and communicating said cavity with the outside and a guide surface defining said guide bore; and a separable die comprising a second die surface connected to said square movement mechanism advanceably and retractably in the X-direction in a manner synchronizing with said square movement mechanism, wherein said second die surface moves in the X-direction away from said cavity during one of the advancement and the retraction of said square movement mechanism in the X-direction, and said second die surface moves in the X-direction in a manner guided by said guide surface of said guide bore and approaches the said cavity and fits in said die main body during the other one of the advancement and the retraction of said square movement mechanism in the X-direction; and a square movement mechanism for synchronously operating said plurality of driving workpiece transfer claws and said plurality of driven workpiece transfer claws both in the Y-direction and the X-direction;

wherein said square movement mechanism further comprises:

a driving mechanism disposed in said driving bolster member;

a driven mechanism disposed in said driven bolster member and driven by said driving mechanism; and a synchronizing mechanism for synchronously transmitting the driving force of said driving mechanism to said driven mechanism.

* * * * *